United States Patent [19]

Viio

[11] Patent Number: 4,523,702

[45] Date of Patent: Jun. 18, 1985

[54] TOOL HOLDER

[76] Inventor: Matti Viio, 191 51 Sollentuna, Sweden

[21] Appl. No.: 523,629

[22] Filed: Aug. 15, 1983

[30] Foreign Application Priority Data

Aug. 17, 1982 [SE] Sweden ..... 8204739

[51] Int. Cl.[3] ..... A45F 5/00

[52] U.S. Cl. ..... 224/101; 206/479; 224/904

[58] Field of Search ..... 224/101, 223, 904, 906; 150/34, 52 R, 52 A, 52 B, 52 C; 206/372, 373, 478, 479, 480, 481, 483, 45.17

[56] References Cited

U.S. PATENT DOCUMENTS

| | | | |
|---|---|---|---|
| 893,608 | 7/1908 | Danne | 150/34 X |
| 1,991,306 | 2/1935 | Woolsey | 206/479 X |
| 2,183,428 | 12/1939 | McNary | 206/479 X |

*Primary Examiner*—Steven M. Pollard

*Attorney, Agent, or Firm*—Hammond & Littell, Weissenberger & Dippert

[57] ABSTRACT

A tool holder comprises an upwardly open receptacle (10) intended to be attached to the clothing of the user. According to the invention one receptacle part (19) is hinged (31) to a plate (11) which is freely pivotable about the hinge location and which is provided with a plurality of slots (12,13,14) arranged to co-act with straps (15,16) or like means to form loops (17) of selected size for holding further tools.

9 Claims, 4 Drawing Figures

TOOL HOLDER

TECHNICAL FIELD

The invention relates to a tool holder of the kind which comprises an upwardly open tool-supporting receptacle intended for attachment to the clothes of a user.

BACKGROUND ART

Holders of this kind are well known to the art. U.S. Patent Literature illustrates many examples of such holders, not only for carrying tools, but also for other purposes. For example, U.S. Pat. No. 3,294,298 describes and illustrates a hammer holder comprising a receptacle having a pocket for the reception of a hammer and means for attaching the receptacle to the clothing of a user. Another type of holder is described and illustrated in U.S. Pat. No. 2,642,576, while a further variant of a hammer holder is described in U.S. Pat. No. 3,384,277.

With regard to specific tool holders, many such are found on the market, although it would appear that these are designed and intended to receive special tools. For example, tool holders are to be found on the market which are intended for specialized workmen, such as carpenters, and which are provided with a plurality of open compartments each of which is intended to receive a given tool. The compartments are thus formed to the shape of the respective tools.

Since these holers are normally designed to suit the tools they are to carry, and are thus bound to these tools, the use of such tool holders is relatively limited. If a workman finds that he must use different tools, he must also find another tool holder.

DISCLOSURE OF THE INVENTION

An object of the present invention is to provide a tool holder of the aforementioned kind which will readily receive any tool, irrespective of its configuration, and which will allow said toll to be retrieved with ease.

An other object of the invention is to provide a tool holder able to receive tools of varying shapes and sizes.

A further object of the invention is to provide a tool holder which will conform to the body of the wearer without hindering his or her movements while working.

These objects are relized by means of a tool holder having the chracterizing features set forth in the claims.

So that the invention will be more readily understood and further features and objects thereof made apparent, a preferred embodiment of the invention will now be described with reference to the accompanying drawings.

PREFERRED EMBODIMENT OF THE INVENTION

Figure 2:
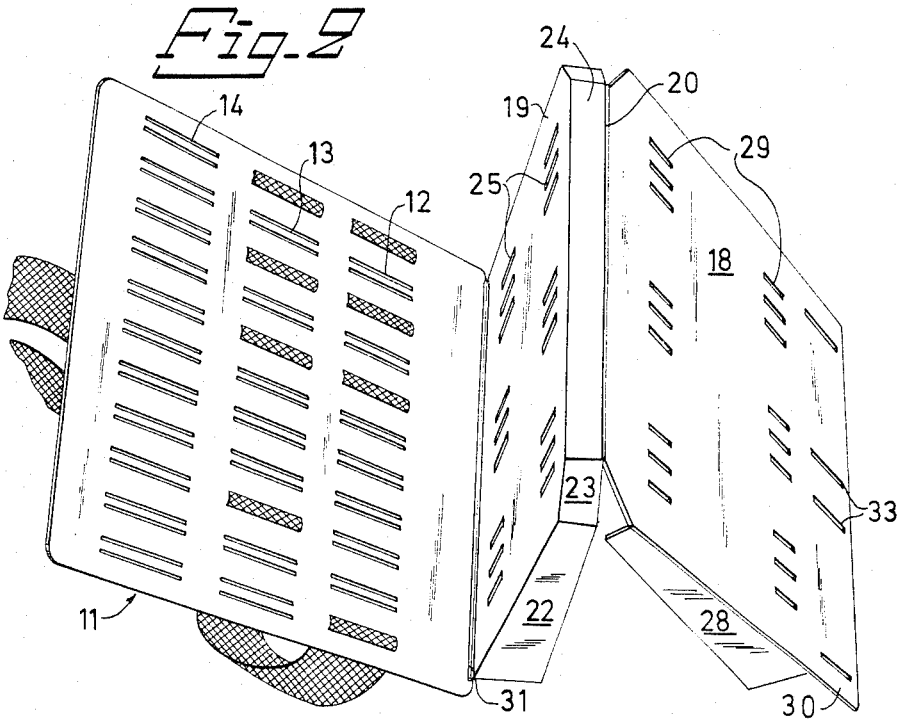
FIG. 2 shows the tool holder of FIG. 1, and illustrates a preferred embodiment of the receptacle.
Figure 1:
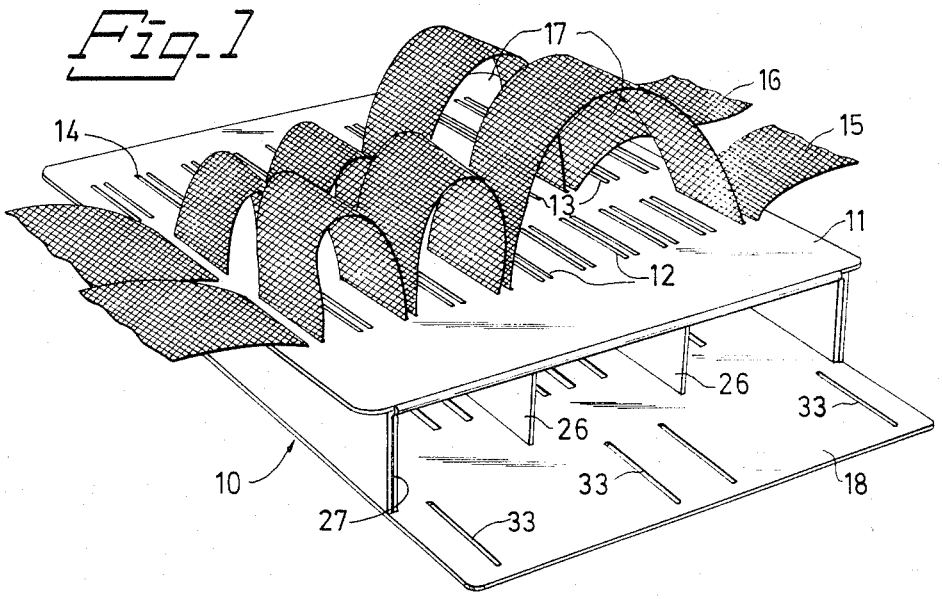
FIG. 1 is a perspective view of a tool holder according to the invention.

The tool holder illustrated in FIG. 1 comprises a receptacle 10 and a plate 11. The receptacle 10 has an open top and is dimensioned to receive different kinds of generally used tools (not shown). The plate 11 is freely pivotable relative to the receptacle 10, and has arranged therein three columns of slots 12, 13, 14, said columns extending across the width of the plate. Each group of slots 12, 13, 14 can be caused to co-act with straps 15, 16 whose vertical extension corresponds substantially to the vertical length of the slots 12, 13, 14. The length of each separate strap may vary, and should greatly exceed the width of the plate 11. By strap is meant here and in the following any suitable pliable device and means. As illustrated in FIG. 2, loops 17 of any given size, can be formed within the limits of the length of the strap or straps and the width of the plate 11, by inserting the strap 15 and/or the strap 16 through selected slots, either adjacent slots or spaced slots, located in the same horizontal plane. Depending upon the shape and size of the tools concerned, it may be sufficient in certain cases to use only the top strap 15, the loops formed therewith restraining the tool both horizontally and vertically.

Tools of reletively excessive length may need to be held and restrained at several locations, in which case the other belt 16 and/or a further belt (not shown) arranged therebeneath can be used. The use of more than one belt may also be useful in the case of tools of highly irregular shape. For example, the loop shown on the extreme right of FIG. 1 and formed by the belt 15 can be intended to carry a portable electric drill. In this case, the loop formed immediately therebeneath by strap 16 can be made smaller, so as to embrace the chuck or front end of the drill.

It will be clear from this that the plate 11 together with the straps 15, 16 and the further strap (not shown) located therebeneath enable tools of widely varying shape and size to be carried. Together with those storage possibilities afforded by the receptacle 10, it will be obvious to all artizans that the novel tool holder is very versatile in use, and is suited to all kinds of craftsmen using varying types of tools.

Figure 3:
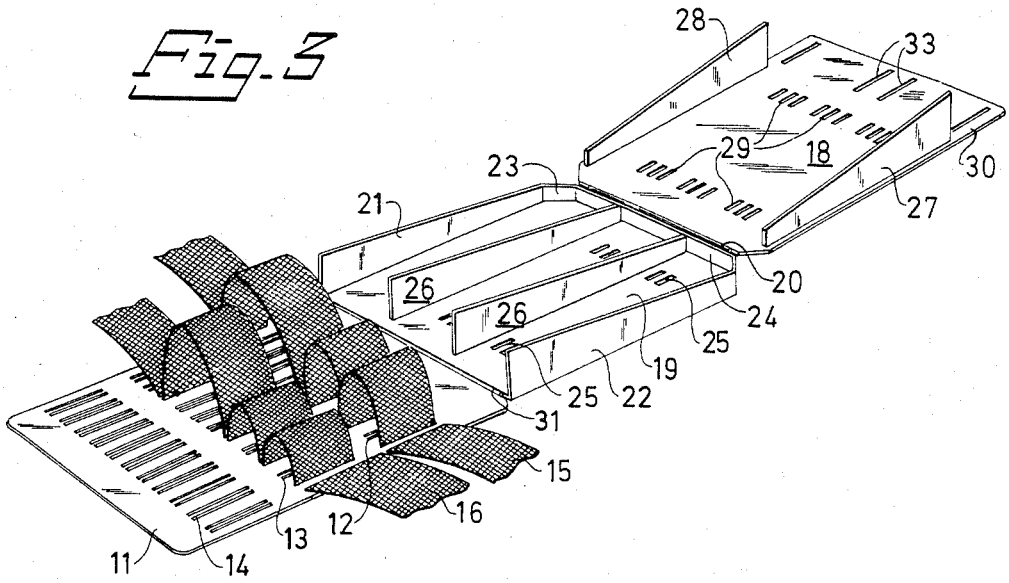
FIG. 3 is a perspective view of the tool holder shown in FIG. 2, and illustrates a number of holder elements.

A preferred embodiment of the receptacle 10 is illustrated in FIGS. 2 and 3.

The illustrated receptacle comprises two hinged planar side plates 18, 19. The ability of the plates 18, 19 to fold relative to one another is indicated at 20, and the hinge means used may be of any known kind.

At least the plate 19 has fixedly attached thereto outer wall elements 21, 22 each having a sloping side, with the broader part facing upwardly in the in-use position of the holder. The plate 19 is also provided with a part 24 which is connected to the wall elements 21, 22 via corner parts 23, said part 24 forming the bottom plate of the receptacle. The wall elements 21, 22, the corner parts 23 and the bottom plate 24 are preferably formed integrally with one another in a one-piece structure, which is then fixedly joined to the plate 19.

As will be understood from the aforegoing and more readily appreciated from the following, the wall elements 21, 22 (a) form outer walls defining the receptacle cavity, (b) impart to the receptacle a tapering configuration, and (c) form spacers between the two plates 18, 19.

In order to increase the versatility of the receptacle 10 and its capacity to receive tools of varying shapes and numbers, the plate 19 is suitably provided with at least two groups of mutually spaced slots 25 arranged in at least two columns. The slots 25 are arranged to receive detachable dividers or partitions 26, thereby to enable a plurality of compartments to be formed in the receptacle 10.

As will be understood, the partitions 26 have the same conicity as the fixed wall elements 21,22 and are provided at their bottom edge with known means for interlocking engagement with the slots 25, e.g. projecting lips which can be locked to the place 19 by displacing the partitions in said slots. One such lip is intended to co-act with a particular slot, and consequently each partition 26 is preferably provided with two lips.

The manner in which the partitions are fixed to the plate 19 forms no part of the invention, and hence will not be described in greater detail.

In order to be able to provide the receptacle 10 with partitions 26, so as to impart a degree of versatility to the tool holder, it is necessary to have access to the inner surface of the plate 19, and thus requires the aforesaid relative foldability of the plates 18,19 indicated at 20. The plate 18 is also planar and may have fixedly connected thereto outer wall elements 27,28, in a manner similar to the plate 19. Similarly, the plate 18 can be provided with slots 29 corresponding to slots 25, for detachably attaching to said plate further sloping-sided partitions, not shown. The outer wall elements 27,28 and the detachable dividers or partitions, not shown, of the plate 18 are not really necessary, although they do give the compartments formed when the plate 19 with partitions 26 and wall elements 21,22 is folded against plate 18 (FIG. 1) a certain rigidity, the respective partitions being so arranged that when the plates 18 and 19 are brought together, each compartment is defined by double walls. FIG. 2 illustrates how when the plates 18,19 are brought together (FIG. 1) they form the vertical walls of the receptacle 10.

As will be seen from FIG. 2, the plate 18 is longer than the plate 19, wherewith the part of the plate 18 extending beyond the top edge of plate 19 forms means for guiding respective tools into the receptacle 10.

As indicated by the reference 31 in FIG. 2, the aforementioned plate 11 of the preferred embodiment is hinged to the plate 19, and thus to the receptacle 10. The hinge means used may be similar to the means used to hinge together the side plates 18,19.

As shown in FIG. 3, the side plate 19 is hinged at its bottom edge to the side plate 18 and at its top edge to the plate 11. As illustrated in FIG. 2, the receptacle 10 (FIG. 1) is formed by swinging the plate 11 and the side plate 18 in mutually opposite directions. It will be understood that the term "hinge" as used here includes any means, such as a scored line, which enables the plates to fold relatively one another. The aforementioned tapered form of the wall elements 21,22 (27,28) gives the receptacle 10 a wide upper opening and a narrowing lower portion defined vertically by the bottom part 24. This arrangement contributes in ensuring that tools held in the receptacle are kept still while the wearer is moving, and for certain tools the side plates 18,19 form friction-promoting surfaces between which the tools are held.

Figure 4:
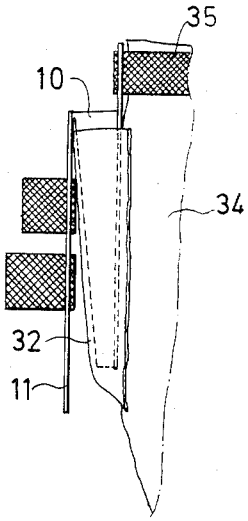
FIG. 4 illustrates a preferred manner of attaching the tool holder to the clothing of a workman.

It will be understood from the aforegoing that the side plates 18,19 are not held together by any mechanical means. The main reason for this is that the tool holder according to the invention is intended to be carried by the user in the manner illustrated in FIG. 4. Thus, the narrower, lower part of the receptacle 10 is intended to be inserted into a pocket 32 of the user's clothing 34. The plate 11 together with its associated straps will thus be located outside the pocket 32. Because of the tapered shape of the receptacle 10 and because of the ability of the plate 11 to pivot, it is a simple matter to insert the receptacle 10 into the pocket 32. The side plates 18,19 will be held either against one another or close together, in dependence upon the type and shape of the pocket used. Consequently, separate locking means would not appear necessary.

However, if the wearer wishes to attack the tool holder to his belt 35, using herefor the extending part 30 of plate 18 with slots 33, it may be necessary to provide such locking means, which may be of any suitable known kind.

Although not shown on the drawing, the ends of the straps 15,16 may be provided with stop means, to prevent unintentional slipping of the straps in respective slots.

The aforedescribed preferred embodiment can be modified within the scope of the following claims without departing from the spirit of the invention.

I claim:

1. A tool holder comprising an upwardly open tool-supporting receptacle arranged for attachment to the clothing of a user, wherein a first side plate and a second side plate forming the receptacle are hinged together, said side plates being provided with fixed outer wall sections, wherein means are provided for detachably mounting between said fixed outer wall sections one or more partitions that form tool-receiving compartments, wherein one end of one of said side plates is foldably joined to a third plate having a plurality of vertical slots arranged therein, said slots being intended to cooperate with straps or like means in a manner to form loops of sufficient size to receive and hold additional tools, and wherein said third plate is freely pivotable about a pivot joint between said third plate and the side plate to which said third plate is foldably joined.

2. The tool holder of claim 1, wherein the receptacle tapers from top to bottom, with the narrower portion of the receptacle at the bottom thereof.

3. The tool holder of claim 1, wherein each of the detachable partitions has two mutually spaced attachment locations.

4. The tool holder of claim 1, wherein each of the fixed outer wall sections and the detachable partitions has a tapered configuration.

5. The tool holder of claim 1, wherein one planar side plate has an upwardly extended portion which forms a means for guiding tools into said receptacle upon their insertion thereinto.

6. The tool holder of claim 5, wherein the upwardly extended portion of said planar side plate is provided with vertical slots which are arranged perpendicularly in parallel and which are intended to co-operate with a belt.

7. The tool holder of claim 1, wherein the vertical slots in the third plate are arranged in three groups lying vertically one above the other, the loops formed by straps inserted through certain of said slots forming holder means for one or more tools.

8. The tool holder of claim 1, wherein the lower end of the receptacle is intended to be inserted into a pocket of the user's clothing, with the third plate placed outside said pocket and the receptacle comprising said side plates enclosed in the pocket.

9. The tool holder of claim 1, wherein said tool holder comprises three mutually hinged planar elements comprising the side plates and the third plate, one of the side plates being arranged to pivot via a hinge means into abutment with a surface on the other side plate to form the receptacle and the third plate being arranged to pivot towards said other side plate via a further hinge means.

* * * * *